United States Patent [19]

Troll

[11] 4,259,806

[45] Apr. 7, 1981

[54] WALKING TOY

[75] Inventor: John H. Troll, New York, N.Y.

[73] Assignee: Summit Licensing Company, New York, N.Y.

[21] Appl. No.: 161,427

[22] Filed: Jun. 20, 1980

[51] Int. Cl.[3] ..... A63H 29/16; A63H 11/00; A63H 3/46; A63J 3/00

[52] U.S. Cl. ..... 46/44; 46/119; 46/1 R; 46/163; 272/8 N

[58] Field of Search ..... 3/12.7, 1.2; 46/44, 46/119, 1 R, 120, 1 C, 163, 174, 175 R, 232, 45; 272/8 N, 27 N; 40/412

[56] References Cited

U.S. PATENT DOCUMENTS

| | | | |
|---|---|---|---|
| 972,920 | 10/1910 | Riggs | 46/119 |
| 1,604,087 | 10/1926 | Tate | 272/8 N |
| 3,071,893 | 1/1963 | Schwartz | 46/163 |
| 3,153,881 | 10/1964 | Banlard-Cogan | 46/163 |
| 3,423,765 | 1/1969 | Salisbury, Jr. | 3/1.2 |
| 3,631,542 | 8/1969 | Potter | 3/1.2 |
| 3,733,743 | 5/1973 | Kossoff et al. | 46/163 |
| 3,792,548 | 2/1974 | Hamano | 46/1 C |
| 4,018,382 | 4/1977 | Di Cuya | 46/163 |
| 4,208,830 | 6/1980 | Yoshida | 46/119 |

*Primary Examiner*—Robert Peshock
*Assistant Examiner*—Michael J. Foycik, Jr.
*Attorney, Agent, or Firm*—Arthur M. Lieberman

[57] ABSTRACT

A simple fluid actuated vehicle is described in the shape of a hollow hand which, by remote bulb pressure, precesses along a given route by means of advancing digits.

2 Claims, 1 Drawing Figure

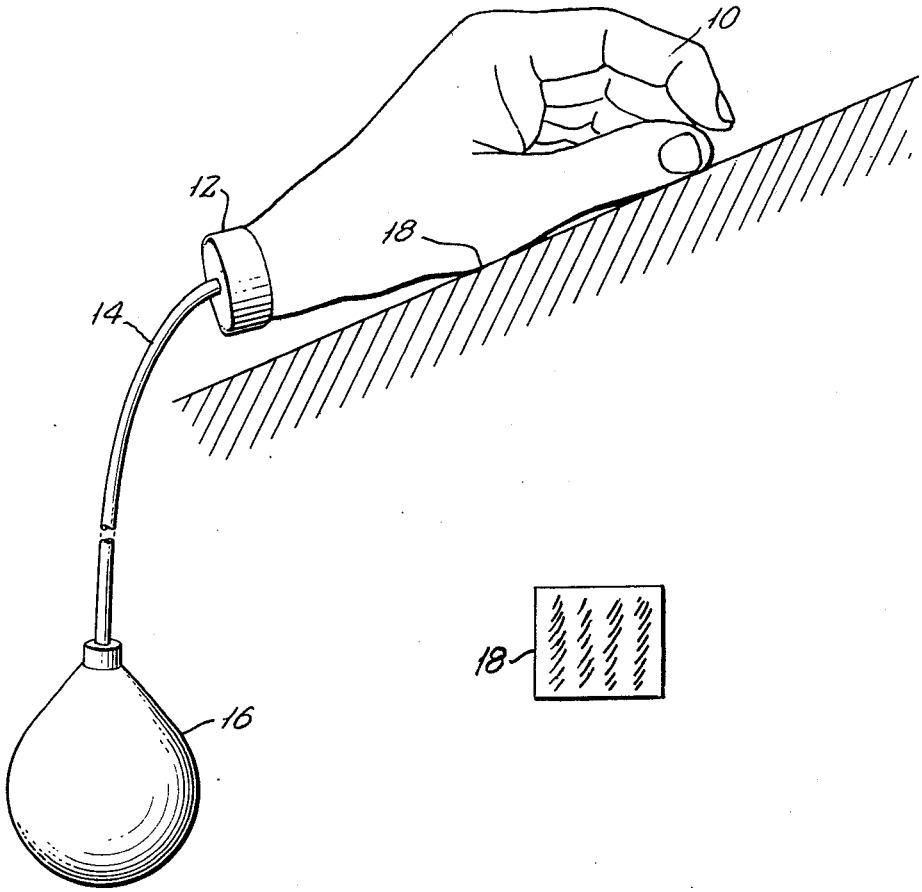
10
12
18
14
18
16

WALKING TOY

PNEUMATIC MOVING HAND TOY OBJECTS AND SUMMARY OF THE INVENTION

This invention relates to a toy and in particular to a hand shaped toy capable of being advanced along regular or irregular surfaces by remote control means.

It is the object of this invention to make a toy which is extremely simple and economical to manufacture and which is capable of human-like articulation.

Other and additional objects and advantages will become apparent from reading the following detailed specification of one embodiment of the invention in conjunction with the drawings, wherein the single FIGURE is a prospective view of the toy of this invention shown in the non-actualized mode.

BRIEF DESCRIPTION OF THE DRAWINGS

The single FIGURE is a side view of a toy constructed in accordance with the invention

DESCRIPTION OF THE PREFERRED EMBODIMENTS

Turning now to the single FIGURE a hand 10 is shown having the usual number of digits. The hand is hollow and is preferably formed of latex or other elastic material capable of returning to a specific set or configuration.

For example, the hand shown will be biased or set in latex in the semi-curled or relaxed position. It is hollow so that a fluid may be contained therein and urged through the coupling member 12, which acts as a stopper hydraulically sealing the hand (pressure fit is sufficient) and providing a coupling through the tube 14 to the bulb 16.

The hand may be manufactured with variable thickness digits such that as the pressure in the bulb is increased (the bulb is depressed) it causes a precessional movement of the digits. Thus, for example, if one would want the index finger to advance first, the index finger would have a thinner latex, and so on, with respect to each digit and its relative time sequence, with the latex becoming thicker as each digit respectively advances. Since there is no reason for the hand proper to expand (i.e., that portion to which the fingers are joined) the greatest thickness of latex would be reserved for the hand itself.

Because fluids such as water and oils are hydraulic in nature, i.e., instantly transmitting their pressure to all points due to the incompressibility of the fluid, it may be preferable to use air as a fluid which permits a pressure build up due to its compressibility.

To permit the hand to walk along a surface, the latex is formed in such a manner at 18 as to provide an area in which a series of hair-like or cilia projections are formed having an orientation to permit forward movement and resist backward movement in the well-known fashion. Alternatively, a variety of commercially available oriented materials may be affixed at the area 18 by contact glue. It may also be advisable to include the same type of material at the finger tips to aid oriented movement of the digits. As an alternative mode, a ratcheted or one-way wheel (not shown) may be appended at point 18.

It will be readily apparent to those skilled in the art that the hand set and the elasticity of the hand will permit reciprocal action with the bulb whereupon depression of the bulb will result in hand digit expansion which, upon release of the bulb, will permit the fluid to return to the bulb.

Although the present invention has been described in conjunction with a particular embodiment, it is to be understood that modifications and variations may be resorted to without departing from the spirit and scope of the invention and any such modifications and variations are within the scope of the invention and appended claims.

I claim:

1. A hand shaped toy comprising a glove of resilient flexible rubber-like material having a palm portion and portions corresponding to digits of a hand formed in the relaxed hand position, a resilient bulb containing a fluid, means fluidically coupling the wrist end of said glove with said bulb for fluid communication therebetween, said glove being of variable thickness at least between the digits and hand whereby movement of said digits relative to said palm occurs when fluid pressure to said glove is increased by depression of said resilient bulb, and means appended to at least a portion of said glove contacting a surface for causing movement of said hand along said surface when said bulb is reciprocally depressed.

2. The hand toy claimed in claim 1 wherein the contained fluid is air.

* * * * *